US010029712B2

(12) United States Patent
Wike

(10) Patent No.: US 10,029,712 B2
(45) Date of Patent: Jul. 24, 2018

(54) STABILIZED RAILWAY FREIGHT CAR TRUCK

(71) Applicant: Amsted Rail Company, Inc., Chicago, IL (US)

(72) Inventor: Paul Steven Wike, Saint Louis, MO (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 276 days.

(21) Appl. No.: 14/958,320

(22) Filed: Dec. 3, 2015

(65) Prior Publication Data

US 2017/0158209 A1 Jun. 8, 2017

(51) Int. Cl.
*B61F 5/04* (2006.01)
*B61F 5/52* (2006.01)

(52) U.S. Cl.
CPC . *B61F 5/52* (2013.01); *B61F 5/04* (2013.01)

(58) Field of Classification Search
CPC ..... B61F 5/52; B61F 5/04
See application file for complete search history.

(56) References Cited

U.S. PATENT DOCUMENTS 5,222,441 A * 6/1993 Weber ..... B61F 5/04 105/208
6,672,224 B2 * 1/2004 Weber ..... B61F 5/04 105/187
8,474,383 B1 * 7/2013 Berg ..... B61F 3/02 105/208
2014/0158016 A1 * 6/2014 Voisine ..... B61F 99/00 105/209

* cited by examiner

*Primary Examiner* — Robert J McCarry, Jr.
*Assistant Examiner* — Scott A Browne
(74) *Attorney, Agent, or Firm* — Amsted Industries Incorporated

(57) ABSTRACT

A stabilized railway car truck consists of two side frames and a bolster. The bolster has laterally opposite ends, each end extending into and supported within a side frame opening on a spring group. The stabilized railway car truck also includes a transom extending into supporting contact with each sideframe by a hinge assembly. The spring group is supported at each transom end. The hinge assembly includes a pin arrangement that allows one sideframe to move vertically with respect to the other sideframe.

1 Claim, 3 Drawing Sheets

STABILIZED RAILWAY FREIGHT CAR TRUCK

BACKGROUND OF THE INVENTION

The traditional three piece railway freight truck consists of one bolster and two side frames that are configured to utilize friction shoes between the bolster and side frames as a means to provide damping of the suspension. The friction shoes additionally provide a limited means to keep the relationship of the side frames aligned squarely to the bolster and wheelsets. Lateral track displacement irregularities are transmitted to the wheelsets and into the side frames creating uneven lateral displacement of the side frames. The uneven displacement of the side frames exceeds the friction shoes' squaring capability, allowing the side frames to pivot or hinge about the friction shoes and bolster. The pivoting or hinging of the side frames yaws the wheelsets, creating misalignment to the railway track, which limits the stability of the traditional three piece freight truck. Further, the parallelograming of the side frames to the bolsters and wheelset is referred to as wrapping. The wrapping of the truck creates misalignment to the railway track, which limits the stability of the three piece truck.

The present invention relates to enhancing the stability of the three piece truck by adding a transom between the side frames. The pivotal, but rigid attachment of the transom to side frames provides warp stiffness between the side frames to prevent parallelograming of the side frames to the bolsters and wheelset, which in turn keeps the truck aligned to the railway track. The transom connects to the side frames in a manner that it can be attached to existing or to new three piece trucks. The rigid pivotal connection of the side frames to transom allows for longitudinal rotation. The longitudinal rotation in parallel with the track, such that truck side frames attached to the wheelsets adjust to track cross level height and irregularities without affecting the warp stiffness of the truck.

The stabilized railway freight car truck bolster is supported on springs. The springs are supported on the transom which is pivotally supported on the side frames.

It is an object of the present invention to provide a railway freight car truck having improved stability and resistance to misalignment with the track.

SUMMARY OF THE INVENTION

A stabilized railway freight car truck of the three piece design is comprised of two laterally spaced side frames and a laterally extending bolster. A transom extends to each side frame. The ends of the transom are pivotally supported by a pin assembly, which itself is supported on an extension from the lower portion of the center openings of the side frames. The spring suspension is supported on the transom, which in turn supports the bolster.

It is also desirable to have translation and warp constraint between the two side frames. The pivotable connections of the transom to the side frames mitigate track input from destabilizing truck performance.

DETAILED DESCRIPTION OF THE INVENTION

Figure 1:
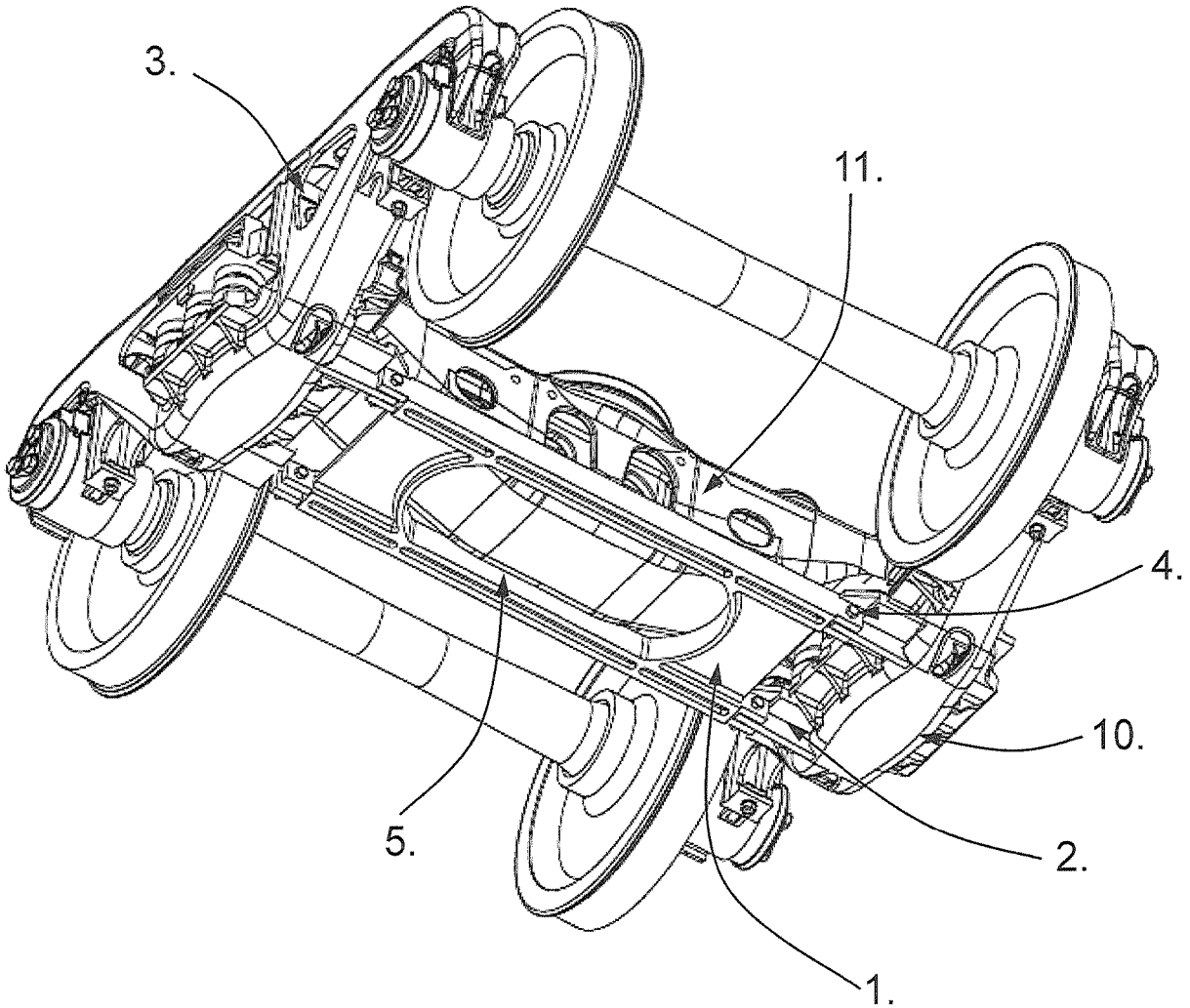
FIG. 1 is a perspective view of the bottom of truck assembly of a first embodiment of a stabilized railway car truck in accordance with the present invention.

Referring now to FIG. 1, a perspective bottom view of the three piece truck with the transom pivotally attached to the cast steel side frames. The side frames 3 and 10 have hinges 2 attached. Such attachment can be made to existing truck sideframes by welding or to new truck sideframes as part of the casting or by welding to new castings. Transom 1 is affixed between the side frames 3 and 10 hinges by pins 4. Transom 1 usually includes a centrally located aperture 5. Transom 1 can be cast of ductile iron or steel, or be comprised of fabricated steel. Bolster 11 is supported at each of its lateral ends by a spring group (not shown), each spring group supported at each lateral end of transom 1.

Figure 2:
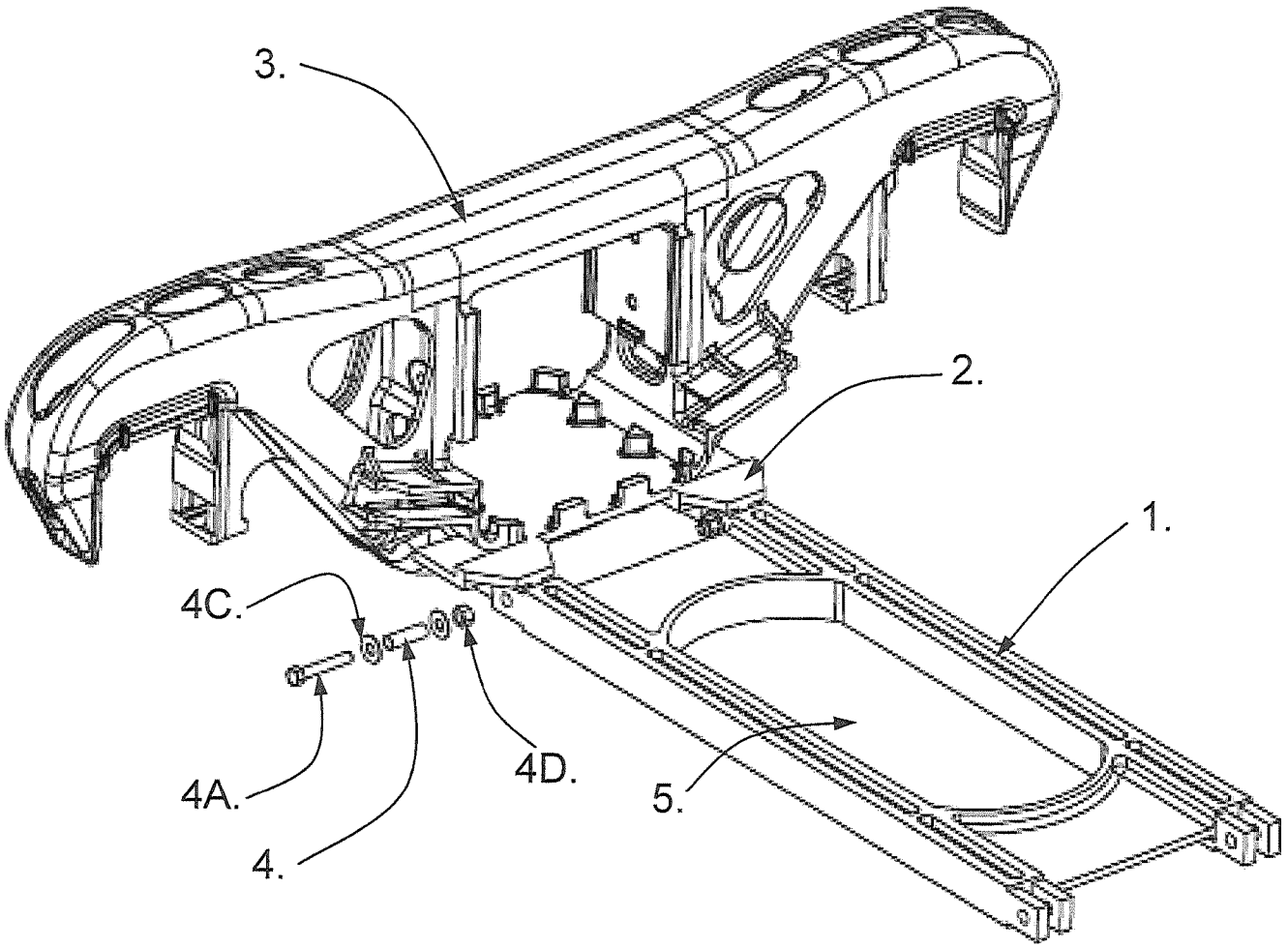
FIG. 2 is a perspective view of the truck assembly of a first embodiment of a stabilized railway car truck in accordance with the present invention showing a transom connected to a sideframe.

Referring now to FIG. 2, a perspective view of one sideframe 3 and transom 1 is shown. Sideframe 3 includes the attachment by means such as welding or the unitary casting of hinges 2 to a lower center portion of the side frame. An identical connection would be made to the other sideframe 10, but is not shown in this figure. Hinge 2 may be fabricated of steel and welded to existing side frames 3 and 10, or the hinge 2 can be cast as part of a new side frames 3 and 10. Transom 1 is longitudinally pivotally attached to the hinges 2 of side frames 3 by pin assembly 4.

Pin assembly 4 consist of a high strength bolt 4A with a steel bushing, washers 4C and a slotted nut 4D and cotter pin to prevent the bolt from loosening.

Figure 3:
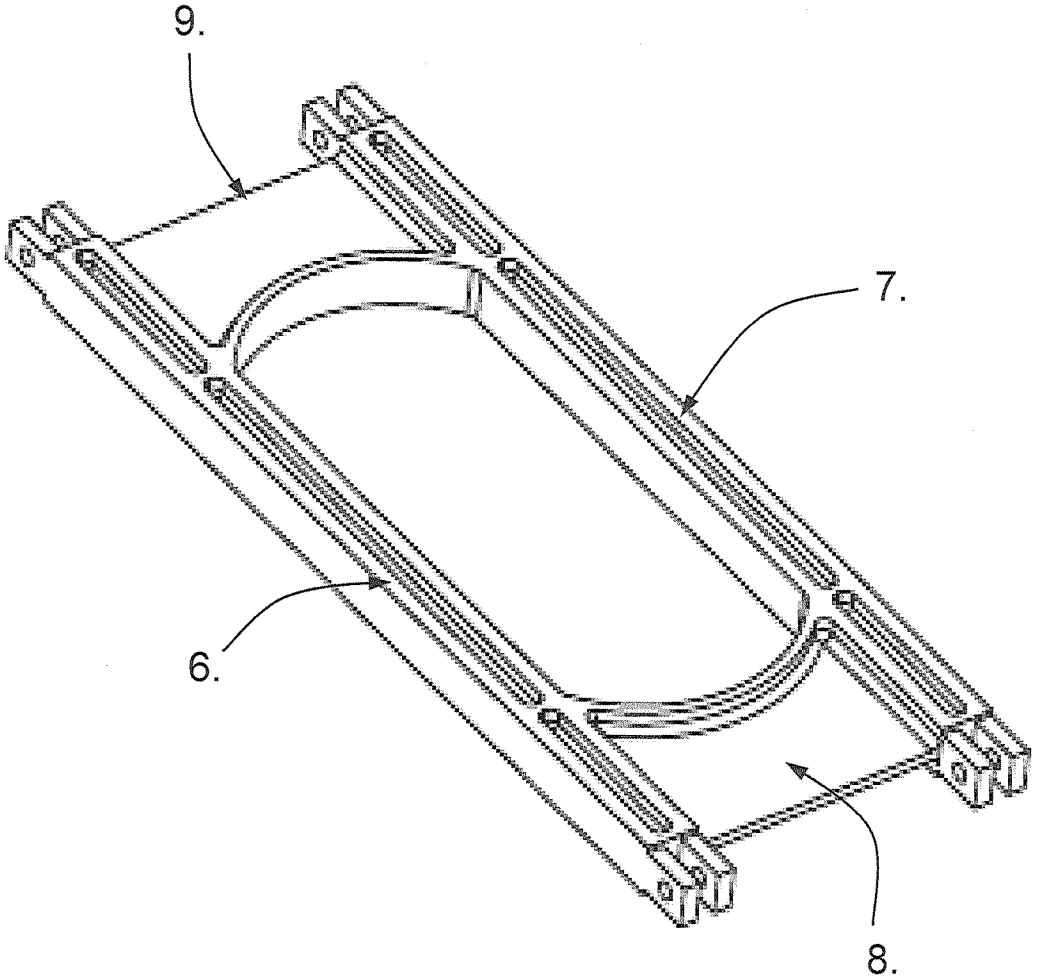
FIG. 3 is a perspective view of a first embodiment of a transom for a stabilized railway car truck in accordance with the present invention.

Referring now to FIG. 3, a perspective view of the transom 1 is shown. Transom 1 warp stiffness is derived by structural columns 6 and 7. They preferably would be cast as I beam structures as part of a cast transom 1. The columns 6 and 7 could be fabricated of steel box sections as part of a fabricated transom 1. To enhance the warp stiffness of columns 6 and 7, web cross supports 8 and 9 are added to add stiffness and structural strength and to reduce the buckling length of columns 6 and 7. Similarly, webs 6 and 7 preferably would be cast as part of a cast transom 1 or could be fabricated from steel and added by means such as welding to a fabricated transom 1.

What is claimed is:

1. A railway freight car truck comprising:

a pair of parallel sideframes, a transom extending laterally between the sideframes, a spring group supported by an the side frames, a bolster extending laterally between the sideframes and supported by the spring group, each sideframe including a transom support, a hinge assembly as a component of each transom support, an end of the transom connected to each hinge assembly of each transom support, the transom includes two horizontal columns and a web joining the columns, and a pivot hinge at an end of each transom horizontal column, each hinge assembly of each transom support on each sideframe comprises an adapter to join with the pivot hinge of the transom to allow one sideframe to move vertically with respect to the other sideframe, a horizontally disposed pivot pin assembly joining each transom column pivot hinge to one sideframe hinge assembly adapter, and wherein each of the transom column pivot hinge and the sideframe hinge assembly adapter include horizontal openings that are aligned to receive a pivot pin as a component of the pivot pin assembly.

* * * * *